United States Patent [19]

Palenscar

[11] 4,074,723

[45] Feb. 21, 1978

[54] PIPE

[76] Inventor: William J. Palenscar, 3788 Highland Drive, Carlsbad, Calif. 92008

[21] Appl. No.: 736,866

[22] Filed: Oct. 29, 1976

Related U.S. Application Data

[63] Continuation-in-part of Ser. No. 588,605, June 20, 1975, abandoned.

[51] Int. Cl.[2] ..... A24F 5/04

[52] U.S. Cl. ..... 131/198 R; 131/216; 131/226

[58] Field of Search ..... 131/198 R, 198 A, 226, 131/216, 223

[56] References Cited

U.S. PATENT DOCUMENTS

| | | | |
|---|---|---|---|
| 2,603,222 | 7/1952 | Brooks | 131/198 A |

FOREIGN PATENT DOCUMENTS

| | | | |
|---|---|---|---|
| 15,867 of | 1887 | United Kingdom | 131/198 R |
| 498,301 | 1/1939 | United Kingdom | 131/198 R |
| 2,532 of | 1860 | United Kingdom | 131/198 R |

*Primary Examiner*—Stephen C. Pellegrino
*Attorney, Agent, or Firm*—Whann & McManigal

[57] ABSTRACT

A smoking pipe consisting of a bowl providing a tobacco chamber and stem having a stem opening connected to the bottom of the tobacco chamber. The wall forming the tobacco chamber has air passages formed in the wall which connect from the upper end of the bowl wall to the bottom of the tobacco chamber where the air passages connect to each other and to the stem opening whereby when the pipe is packed with tobacco and lighted air will be drawn through the air passages to the stem opening and will also be drawn into the body of tobacco below the burning area, where it is mixed with the smoke of the burning tobacco and withdrawn from the tobacco chamber through the stem opening.

7 Claims, 4 Drawing Figures

3/32nds of an inch and the width of the groove depending on the circumference and depth of the bowl is in the order of from ten thousandths to forty thousandths of an inch.

The grooves are preferably made with rectangularly arranged side and bottom walls. The corners where the grooves contact and join to the surface 20 of the bowl, which defines the tobacco chamber, are sharpe corners and the side walls of the groove or air passage and the pipe bowl surface are at right angles to each other and thus form the sharp corners.

The dimension of the groove may be varied, for example, where the diameter of the tobacco chamber is smaller, thinner grooves of ten-thousandths of an inch wide may be superior, while a larger diameter of tobacco chamber is superior where the grooves are approximately twenty-thousandths of an inch wide.

The grooves are formed small enough to enable the use of available cuts of pipe tobacco, and to be effective in preventing the tobacco from entering the groove or entering the groove to the extent that the free flow of air is impaired. A minimum of air passages must be used to insure the integrity of the meeting of the grooves at the juncture chamber 17. If there are too many air passages, or if the air passages are too wide, the juncture chamber, which is formed by the crossing of the air passages, will be too large and small pieces of tobacco may enter the juncture chamber and interfere with the free flow of air.

Because of the cross-sectional size of the stem opening tobacco may collect where the opening 14 joins the groove 16 at the point 19, I deepen the groove to which the stem opening is connected as indicated at **16*a* so that if any clogging occurs the air may bypass the clogged portion through the deepened portion of the groove. Also, in certain cases I may desire to deepen the groove at 16*b* which is above the stem opening 14**.

FIG. 3 shows the tobacco chamber packed with tobacco 22, being firmed in place to obtain as even a density as possible.

The tobacco burning as indicated at 23 is kept alive by drawing air through the stem opening 14. When the smoker draws on the stem, air is drawn downwardly through the burning portion of the tobacco, as indicated by the arrows 24. This draws air with its oxygen through the coals, and causes the burning process to continue and the burning action moves downwardly as the pipe is smoked. The smoke from the burning tobacco is drawn downwardly through the tobacco as indicated by arrows 25 and flows into the juncture chamber 17, and also toward the stem opening, as shown by the arrow 26, and thus reaches the stem opening 14 and ultimately the mouth of the smoker.

At the same time air is drawn into the air passages indicated by the arrows 27 and flows downwardly through these passages. Because the air passages 16 are in connection with the tobacco chamber 11 throughout its entire height, the air is drawn into the tobacco as indicated by arrows 28 and this air mixes with the smoke. The air entering the tobacco keeps the tobacco cool below the burning area. It also dilutes the smoke and cools the smoke so that when the mixture of smoke and air reaches the lower end of the tobacco chamber and passes outwardly through the outlet opening 14 the smoke is at a highly satisfying temperature and will give a "cool" smoke. Also, a part of the air will flow through the air passages 16 to the stem opening 14 without entering the tobacco, as indicated by the arrows, in the air passages in the lower part of the bowl, as shown in FIG. 3. The total cross-sectional area of air passages is such that the flow of air through the air passages will be restricted to the extent that the flow of air will not be so great that the flow of air through the tobacco in the chamber will be reduced to a minimum or to zero. Applicant's results depend upon the cross-sectional area of the air passages as being such that when the smoker draws on the pipe air will flow downwardly through the tobacco in the tobacco chamber and also downwardly through the air passages. With this balance the center portion of the charge of tobacco will receive the necessary oxygen so that burning will continue and, in addition to this, the annular peripheral portion of the tobacco in the chamber will receive air from the air passages and combustion will be supported in the peripheral part of the tobacco, thus giving a burning of tobacco across the entire diameter of the charge of tobacco. In addition to this, some of the air will be pulled downwardly through the air passages in the bottom of the tobacco chamber flowing around the "heel" of the tobacco and directly into the stem opening, as shown by the arrows in FIG. 3.

The smoker can, for the most part, control the amount of air which goes into the load of tobacco by the tightness with which he packs it. If the tobacco is packed very lightly the more air is sucked into the tobacco or if the tobacco is packed tightly, then more of the air is drawn downwardly to the juncture chamber, and, thence out of the pipe bowl and into the stem opening as indicated by the arrow 30.

The active flow of air and smoke through the volume of tobacco at the very bottom of the tobacco chamber reduces moisture and the undesirable heel which, as previously referred to, is a wet and soggy portion of the tobacco at the bottom of the bowl, and thus enables the tobacco to burn substantially to the bottom of the bowl, and at the same time eliminates the undesirable taste produced by the moisture which would ordinarily have collected at the bottom of the bowl.

The inside of the bowl and the grooves of my pipe are very easy to clean, this being done by a blade-like tool which can be inserted in the grooves and moved longitudinally, and in this way clean the grooves while the sharp corners are maintained.

I claim:

1. A pipe, a combination of:

(a) a bowl having a side wall and a curved bottom forming a tobacco chamber;

(b) a plurality of air passages in said side wall and said bottom, said air passages extending from the top portion of the tobacco chamber to the bottom thereof, said air passages each having a rectangular cross-sectional shape to have passage side walls and a bottom wall with the width of each passage being sufficiently narrow to prevent tobacco particles from entering said air passage, said passage side walls intersecting said bowl side wall at essentially right angles to form sharp corners so that tobacco is prevented from entering said air passage, said air passages intersecting each other at the bottom of said tobacco chamber to form a junction, and (c) a stem extending laterally from said bowl and having a stem opening extending longitudinally therein, said stem opening being connected to one of said air passages near the area of the tobacco chamber bottom to form a connection, said connec-

PIPE

This application is a continuation-in-part of my pending application, Ser. No. 588,605, filed June 20, 1974, now abandoned

BACKGROUND OF THE INVENTION

A smoking pipe consists of a bowl and a stem. The bowl is packed to a proper density and the tobacco is lighted and kept lighted by drawing air through the tobacco by way of the stem. Pipe smoking is to a pipe smoker an enjoyable experience when the aroma of the tobacco and the aroma and flavor of the smoke are at their maximum taste-appetizing state. However, the pleasure of pipe smoking is considerably lessened if any one of a number of things occur. Many pipes will burn hot with the result that the smoke is too hot and its flavor and aroma is deteriorated. Also the bowl becomes almost too hot to touch and must be handled by the top edge and the bottom of the bowl or by the stem. If the heel of tobacco in the bottom of the bowl becomes soggy all of the tobacco will not burn because of the moisture settling in the lower part of the tobacco chamber during the burning process, including moisture from the smoker's mouth. This ruins the flavor and aroma of the smoke and also there is a substantial waste of tobacco. In many prior art pipes the burning or combustion becomes uneven and the fire may go out. This usually occurs because of the tobacco being packed too tightly for the type and cut of tobacco used and because the air which is pulled through the tobacco flows unevenly therethrough and causes uneven burning.

SUMMARY OF THE INVENTION

I have found that disadvantages and defects of prior art pipes can be eliminated where the tobacco, as it burns, is separately fed the right amount of air evenly distributed through the load of tobacco in the pipe bowl.

It is an object of my invention to provide a pipe which incorporates means whereby air is supplied to the load of tobacco through a path other than being drawn through the burning part of the tobacco, and to provide a pipe having passage means whereby air may be drawn into the bowl of the pipe at various locations where it may be mixed with the smoke in the tobacco chamber and then drawn through the stem into the mouth of the smoker.

It is an object of my invention to provide the pipe bowl with a plurality of passages which surround the tobacco and provide a means whereby when the smoker draws through the stem not only will air and smoke be drawn through the burning tobacco, but additional air will be drawn into the tobacco below the burning portion and thus mix with the smoke as previously pointed out.

In the preferred form of my invention I provide the passage means in the form of grooves in the bowl wall extending from the top of the pipe bowl down to the bottom thereof, and opened at least a major part of the length, the passages being connected to each other and to the stem opening at the bottom of the bowl.

By this arrangement the air is drawn into the pipe and into the tobacco through the air passage means and not solely through the top burning volume of the tobacco. In other words, part of the air is drawn through the burning portion of the tobacco to keep it lighted while other air is drawn through the passages into the tobacco where it is mixed with the smoke and air will also be drawn through the air passages to the stem opening in order to temper it into a smooth cool mixture of air and smoke which is highly pleasurable to the smoker. The additional air gives an "easy draw". Air flows through the lower portion of the tobacco usually referred to as the heel, and increases the air flow through the heel and prevents exclusive collection of moisture and because of the easy draw will not cause a slug of moisture to be drawn into the mouth of the smoker.

It is a further object of my invention to prevent clogging of air passages where the stem opening connects to the bowl.

Other features and advantages of the invention will be made evident during the course of the detailed description of a preferred form of my invention.

DESCRIPTION OF THE PREFERRED EMBODIMENTS

Figure 2:
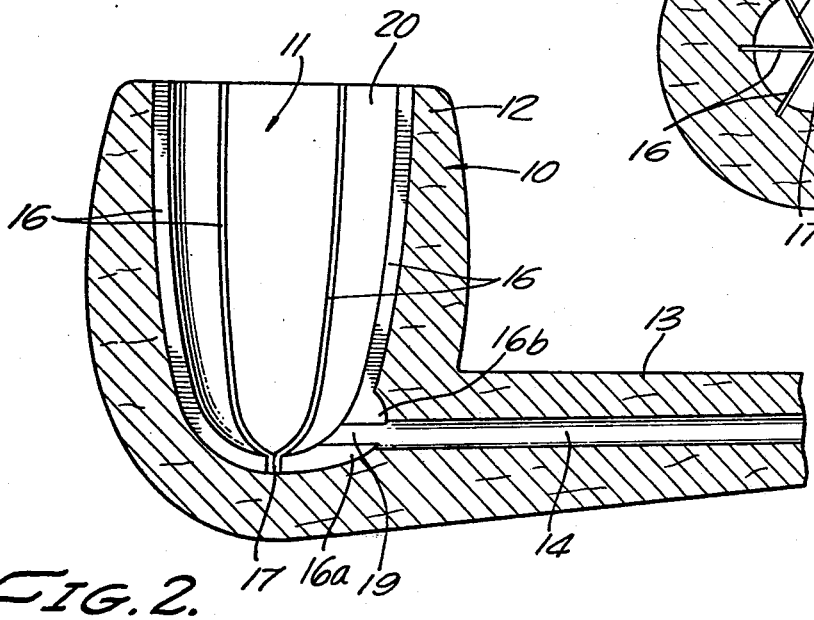
FIG. 2 is an enlarged sectional view taken on the line 2—2 of FIG. 1.
Figure 3:
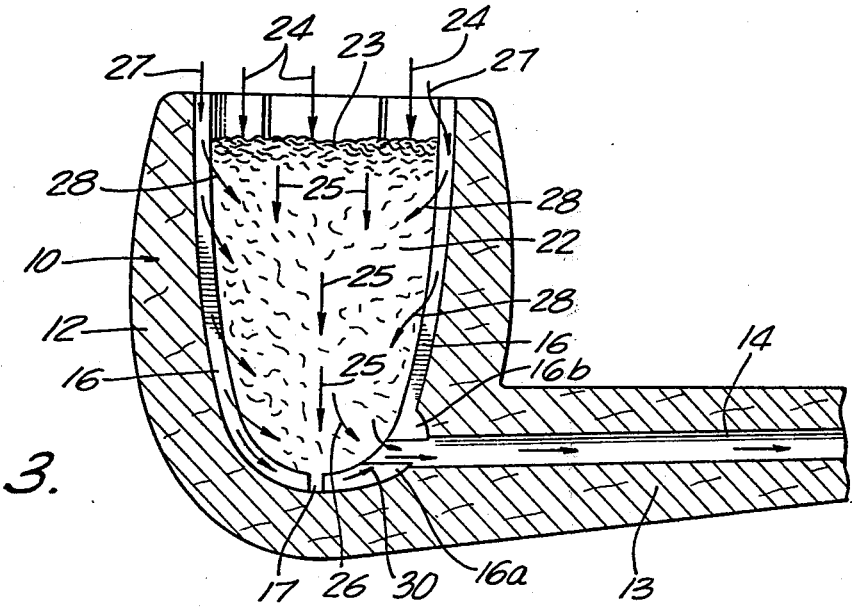
FIG. 3 is a view similar to FIG. 2, but showing the bowl of the pipe charged with tobacco and indicating the manner in which air is drawn through the passage means.

Referring to the drawings, the pipe of my invention consists of a pipe having a bowl 10 with a tobacco chamber 11 formed by the bowl wall 12. Extending from the bowl 10 is a stem 13 having a stem opening or passage 14 which connects to the bowl near the bottom thereof, as shown in FIG. 2. These parts may be "standard sizes and shape", such as is found in the prior art.

Figure 1:
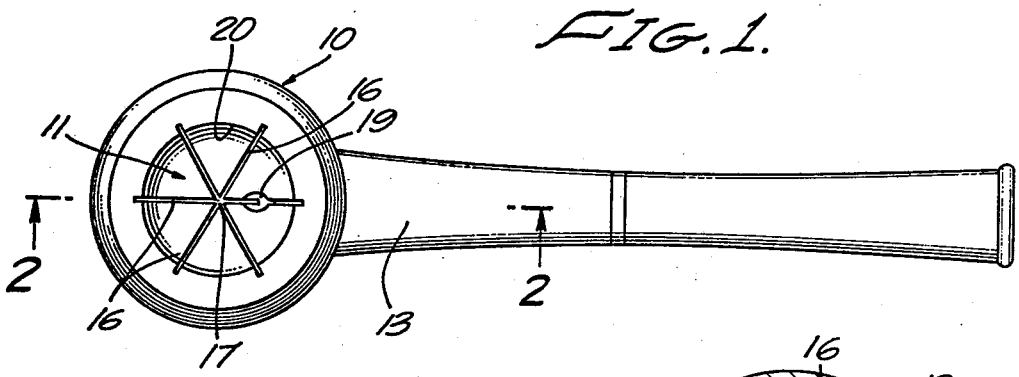
FIG. 1 is a plan view of a pipe incorporating the features of my invention.
Figure 4:
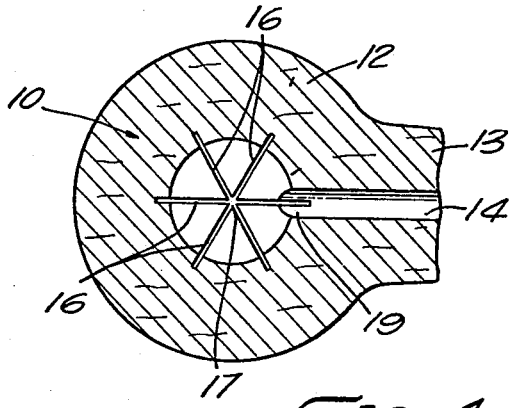
FIG. 4 is an enlarged fragmentary sectional view in looking downwardly at the lower part of the bowl and tobacco chamber and showing the precise manner in which the air passages and stem opening are connected together.

In my invention I provide air passages 16 which extend from the top end of the bowl 10 to the bottom thereof, where they are connected together by a connecting chamber or juncture chamber best shown at 17 in the enlarged view FIG. 4. The air passages 16 are adequate to supply the required amount of air and I prefer to use six air passages which are arranged in three pairs, the pairs of passages being diametrically arranged, each pair being in a diametrical plane, as shown in the plan view of FIG. 1.

In the manufacture of the pipe and the forming of these passages I use a small rotating cutter having a depth gauge, which cutter is placed at the top of the bowl and moved downwardly, then laterally across the bottom of the bowl, and then upwardly along the wall on the opposite side of the bowl.

The six air passages or three pairs of air passages cross at the lower point in the tobacco chamber and thus form the juncture chamber 17. The stem opening is connected to one of the air passages as indicated at 19, and, therefore, the stem opening 14 is connected to the juncture chamber so that it is thereby connected to all of the air passages.

The air passages as shown are in the form of rectangular grooves connected to the tobacco chamber throughout their entire length. In practice I find it satisfactory if the depth of the groove is approximately tion being spaced apart from said air passage junction.

2. A combination as defined in claim 1, in which said air passages are of a width in the order of ten to forty-thousandths of an inch.

3. A combination as defined in claim 1, in which said air passage to which said stem opening is connected to deepened at least below said stem opening in order to provide an air bypass.

4. A combination as defined in claim 1, in which said air passages are relatively narrow and of a width which will prevent tobacco particles from entering the same, and also said air passages provide air which is drawn downwardly through said air passages and will flow into the tobacco in said tobacco chamber, and in which a portion of the air will also flow through said air passages to said stem opening without flowing into the tobacco in said tobacco chamber.

5. A combination as defined in claim 1, in which said air flow will flow through and around the tobacco heel at the lower part of said tobacco chamber, thus reducing the collection of moisture in said heel, and enhancing the burning of the tobacco of said heel.

6. A combination as defined in claim 1, in which there are six air passages arranged in three diametral planes and cross each other to form the juncture chamber, and in which said stem opening is connected to said air passages above the bottom of said bowl.

7. A combination as defined in claim 1, wherein said stem opening intersects said one air passage at an angle.

* * * * *